United States Patent [19]
Francis
[11] 4,365,495
[45] Dec. 28, 1982

[54] METHOD OF MAKING A MANDREL FOR A SELF PLUGGING BLIND RIVET

[75] Inventor: Albert C. Francis, Bennington, England

[73] Assignee: Aerpat A.G., Zug, Switzerland

[21] Appl. No.: 162,935

[22] Filed: Jun. 25, 1980

Related U.S. Application Data

[63] Continuation of Ser. No. 57,355, Jul. 13, 1979, abandoned, which is a continuation of Ser. No. 869,282, Jan. 13, 1978, abandoned.

[30] Foreign Application Priority Data

Jan. 13, 1977 [GB] United Kingdom ..... 1396/77

[51] Int. Cl.³ ..... B21K 1/58; B21D 17/04; B21H 3/06

[52] U.S. Cl. ..... 72/88; 10/27 R

[58] Field of Search ..... 10/27 R, 27 E, 155 R, 10/155 A; 72/88, 89, 90; 411/34, 41, 43, 70

[56] References Cited

U.S. PATENT DOCUMENTS

| | | | |
|---|---|---|---|
| 1,955,980 | 4/1934 | Sinclair | 10/27 R |
| 3,044,332 | 7/1962 | Siebol | 72/90 |
| 3,148,578 | 9/1964 | Gapp | 411/34 |
| 3,369,289 | 2/1968 | Gapp | 411/43 X |
| 3,426,375 | 2/1969 | Jeal | 10/27 R |

*Primary Examiner*—Ervin M. Combs
*Attorney, Agent, or Firm*—Oblon, Fisher, Spivak, McClelland & Maier

[57] ABSTRACT

A mandrel for a blind rivet is made by first forming a mandrel blank from wire stock in a series of cold heading operations which include forming an enlarged head at one end of an elongate stem, and then scraping material from the peripheral surface of part of the head adjacent to the stem and moving the material in a direction away from the stem so as to leave a core and to form a circumferential flange-like boss from the scraped material. The mandrel blank thus produced is then subjected to a rolling operation in which the mandrel blank is rolled between contoured mandrel-rolling dies and thereby formed into a finished mandrel. In particular, the contours of the rolling dies are such as to form a breaker groove at the junction between the head and stem of the blank and to cause the material of the flange-like boss to flow over the scraped surface of the core of the head and towards the stem and form a skirt peripherally of the core while confining the material of the boss so that it does not flow across the breaker-groove. Pulling grooves are rolled in the mandrel stem and the external surface of the skirt is rolled to a cylindrical shape with, optionally, a peripheral groove therein.

12 Claims, 15 Drawing Figures

80
96
88
89
87
89a
96
66

80
88
32
96
62

80
86
94
62

80
86
32
66

80
52
50
94
90a
90
86
84
32
92
82
66
62

METHOD OF MAKING A MANDREL FOR A SELF PLUGGING BLIND RIVET

This application is a continuation of application Ser. No. 57,355 filed July 13, 1979 abandoned, which is a continuation of application Ser. No. 869,282 filed Jan. 13, 1978 abandoned.

This invention relates to a method of making a mandrel for a self-plugging blind rivet of the kind which comprises a tubular rivet shell and a mandrel having an elongate stem and an enlarged head which, in use of the rivet, is pulled into the shell to radially expand the latter to form a blind head, the mandrel head being left plugging the bore of the shell.

More particularly, the invention is concerned with a method of making such a mandrel in which the head of the mandrel is formed with a deformable skirt which, after the rivet has been set, can be deformed so as to engage the shell of the rivet and thereby assist retention of the mandrel head in the shell.

In the past, various methods have been employed for making such mandrels, the details of the method varying to some extent according to the detailed configuration of the particular mandrel being produced. A generally favoured basic method is first to form wire stock into a mandrel blank having an elongate stem and an enlarged head and then to subject the blank to a rolling operation analogous to thread rolling and thereby impart the final properties and configuration of the finished mandrel to the blank.

One such method is described in U.S. Pat. No. 3,044,332 according to which a blank is first formed by extruding or other conventional operation and is then rolled in a single pass between a pair of suitably contoured dies. During the pass between the dies, the blank is subjected to a number of operations which include rolling a circumferential groove which demarcates the blank into a head (referred to therein as a "shank") and a stem whereby there is also produced on the head a circumferential flange immediately adjacent to the groove, and then rolling the flange over the groove, so that the flange becomes a peripheral skirt which overlies the groove and part of the stem and encloses the groove which thus becomes an enclosed annular recess, the skirt having a radially inner surface of cylindrical shape facing into the recess, and a frusto-conical outer surface which converges towards the stem from a base diameter equal to that of the head.

The mandrel formed by the earlier process has two inherent disadvantages which cannot be eliminated by any simple modification of the manufacturing method. These disadvantages are that it is virtually impossible to inspect the recess (which in use serves as a breaker groove for determining the force required to break the stem from the head and the position of the break) for the exercise of quality control, and that by reason of the fact that the skirt tapers externally towards the stem, it contains less material than could otherwise be available for the formation of a locking flange for locking the mandrel head in a rivet shell and hence the strength of the locking is less than could be achieved with another construction.

I have now devised a method suitable for making mandrels which do not have these disadvantages.

According to the invention there is provided a method of making a mandrel for a blind rivet, which method comprises first forming a blank having a generally cylindrical stem and a head, which head comprises a core portion adjacent to and of substantially the same diameter as the stem, a boss spaced from the stem by the core portion and having a diameter greater than the core portion, and an end portion adjacent to the boss and having a diameter greater than the boss, and then rolling the boss over the core portion to form a skirt which peripherally surrounds the core portion and which has a greater diameter than the stem, and confining the material of the boss forming the skirt so that the skirt presents a shoulder facing towards the stem but does not extend beyond the core in the direction of the stem.

According to a further feature of the invention, the blank referred to in the preceding paragraph may be formed from a blank precursor having a generally cylindrical stem and a head, wherein the head comprises a first part adjacent to the stem and of substantially greater diameter than the stem, and an end part of greater diameter than the said first part, the method including the step of moving peripheral material from the surface of the said first part of the blank precursor in a direction away from the stem to leave the said core of substantially the same diameter as the stem, and forming the said boss at a position spaced from the stem out of the peripheral material moved from the core.

The peripheral material may be moved from the surface of the said first part by scraping the peripheral material towards the end part of the head.

The invention will now be described by way of example, with reference to the accompanying diagrammatic drawings, in which:

FIGS. 1 to 4 illustrate final phases of four successive stages of a cold heading operation in making a mandrel blank from a piece of wire stock;

FIG. 3*a* is a detailed view corresponding generally to that of FIG. 3 but showing an earlier phase in the third stage of cold heading;

FIGS. 4*a* and 4*b* are detailed views corresponding generally to that of FIG. 4 but showing two earlier phases of the fourth stage of cold heading;

Figure 1:
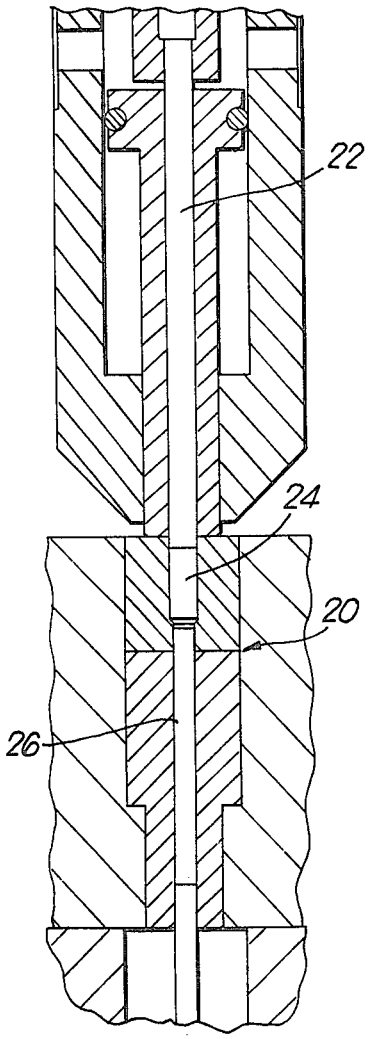

In this example of the invention, mandrel blank is formed from a cut length of cylindrical wire stock by a process of cold heading in four stages, shown in FIGS. 1 to 4, a heading machine of generally conventional construction. FIG. 1 shows the final phase of the first stage in which the cylindrical wire stock has been shaped in a composite fixed die block 20 by heading with a movable tool 22. The tool 22 has compressed the wire stock axially in the fixed die block 20 so that wire stock has become a blank precursor which is distinguishable into a head region 24 and a stem region 26.

Figure 2:
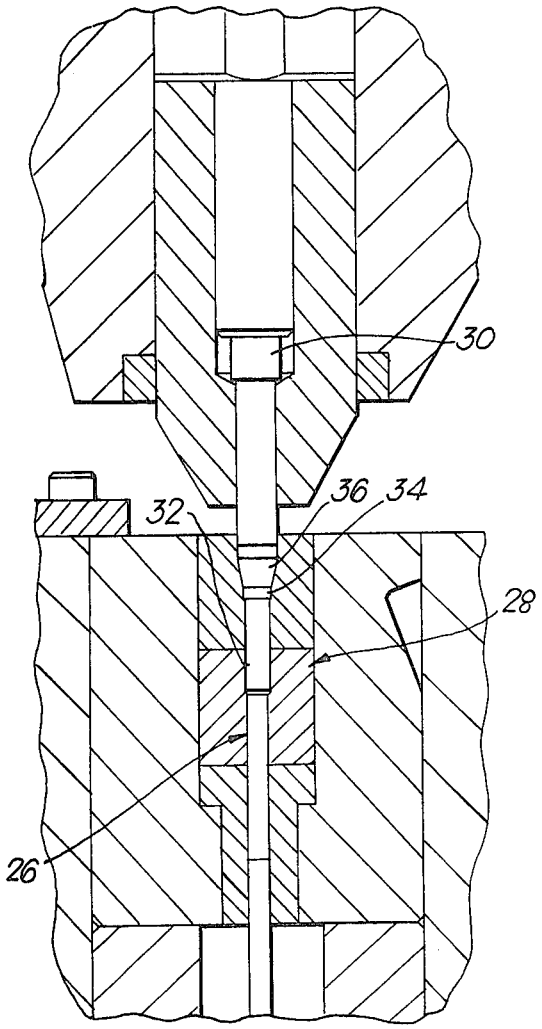

In the second stage, shown in FIG. 2, the precursor has been shaped in a fixed die block 28 by means of a movable tool 30 so that a part 32 of the stem adjacent the head has increased in diameter and the head has been developed so as to have a first part 34 adjacent to the stem and of substantially greater diameter than the stem part 32, and an end part 36 of greater diameter than the first part 34.

Figure 3:
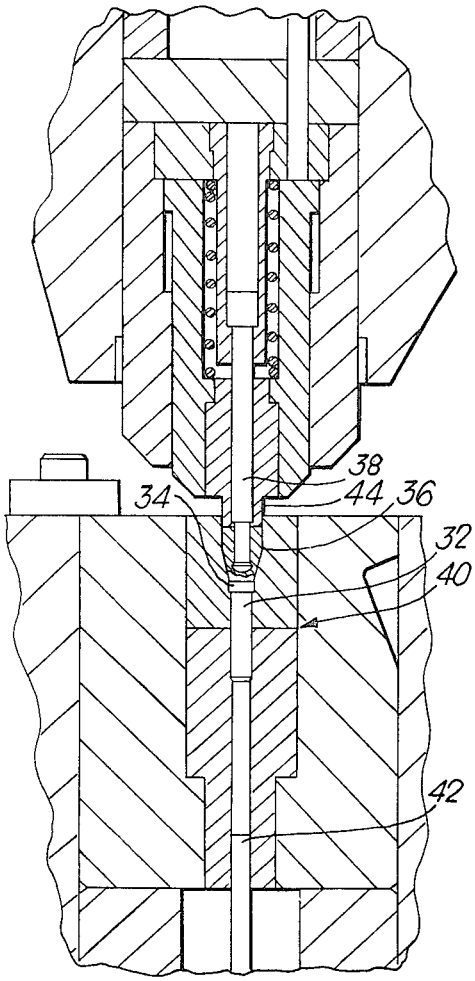
Figure 3A:
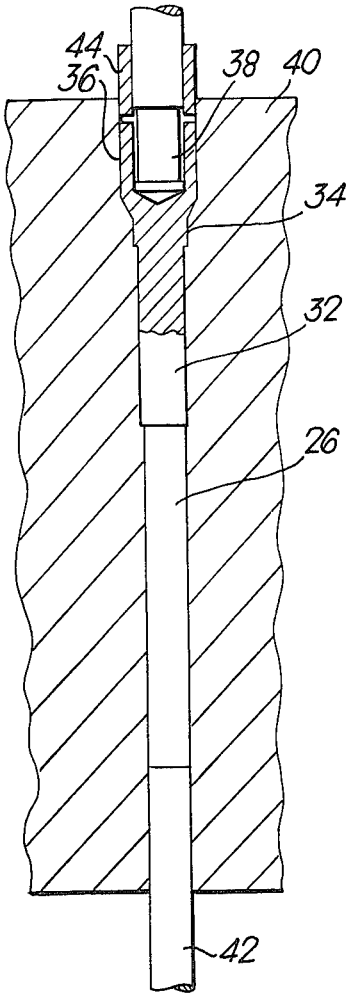

In the third stage, shown in FIG. 3, the head has been extruded over a movable extrusion pin 38 by axial penetration of the pin into the head so that the head now has an axial recess. FIG. 3*a* shows an earlier phase of this stage in which the extrusion of the head is complete. Referring to FIG. 3*a* the blank precursor, shown partly in section, is supported against axial movement in a fixed die block 40 by an ejector pin 42, and the movable extrusion pin 38 is penetrating axially into the head of the blank precursor and causing extrusion of the head around the extrusion pin. Surrounding the extrusion pin 38 is a sleeve 44 which is movable with the pin 38 and spaced from the end of the pin which enters the head of the blank precursor. As shown in FIG. 3*a*, the incompletely extruded head of the precursor is spaced from the sleeve 44. Extrusion of the head of the precursor by penetration of the pin 38 continues until the head meets the sleeve 44, as shown in FIG. 3.

Figure 4:
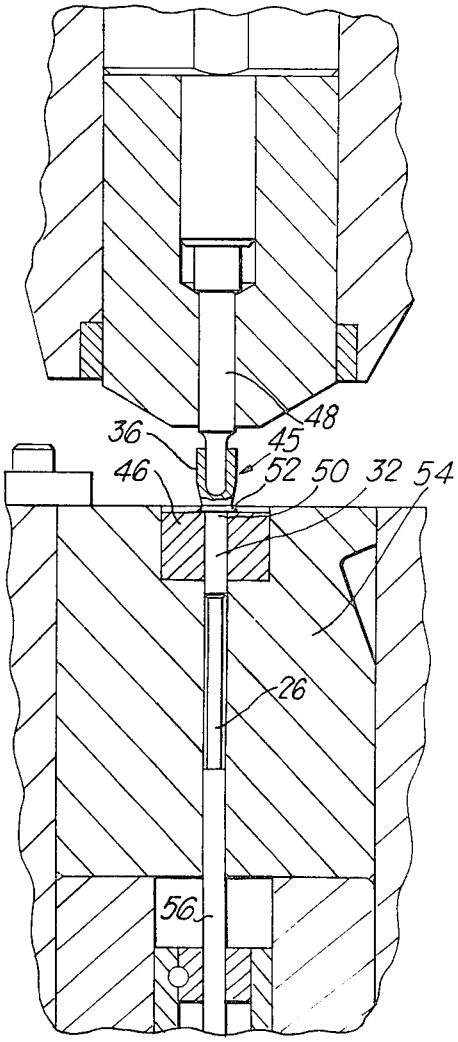

In the fourth stage, the formation of a mandrel blank 45 is completed as shown in FIG. 4. During two successive earlier phases of this stage, shown in FIGS. 4*a* and 4*b* respectively, the first part 34 of the head is scraped in a direction away from the stem by relative movement between the blank precursor and a fixed annular scraping die 46, this relative movement of the precursor being produced by movement of a ram pin 48 which engages in the axial recess in the head of the precursor and pushes the precursor in the direction away from the head and towards the stem of the precursor.

By the scraping operation which is performed in the fourth stage, material is scraped from the peripheral surface of the first part 34 of the head of the blank precursor by the scraping die 46 and moved in a direction away from the stem, the removal of the peripheral material of the first part of the head reducing its diameter to leave a core 50 of the same or minutely greater diameter than the thickened part 32 of the stem. The material which is scraped from the periphery of the first part 34 of the head is not detached from the head but is built up into a circumferential flange-like boss 52 at a position between the core 50 and the large diameter end part 36 of the head of the resulting mandrel blank 45.

Figure 4A:
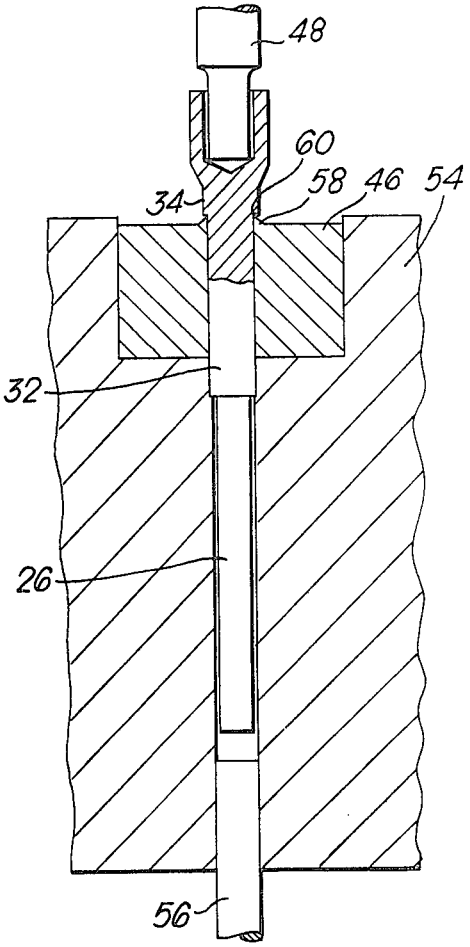

Referring to FIG. 4*a* in which is shown an early phase of the fourth stage, it will be seen that the scraping die 46 is mounted in an annular bolster 54 and that the die 46 and bolster 54 fit closely to the stem 26 of the blank precursor. An ejector pin 56 is slidable in the bolster for ejecting the formed mandrel blank from the die and bolster. The upper surface of the scraper die 46 has a conical projection 58 peripherally of its orifice, this projection tapering upwardly to a sharp annular cutting edge 60. The diameter of the orifice of the scraper die is such that cutting edge 60 is a sliding fit around the thickened part 32 of the stem but is smaller than the diameter of the first part 34 of the head.

Figure 4B:
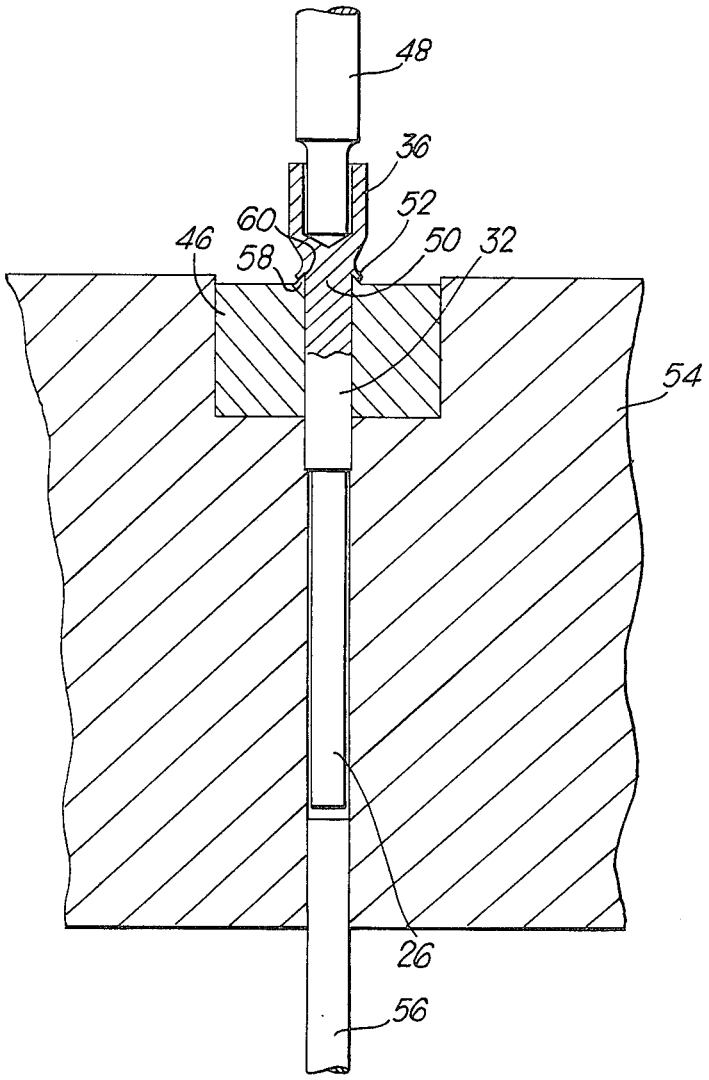

When the blank precursor is first introduced into the fourth stage cutting die and its associated bolster, the first part 34 of the head of the precursor rests upon the cutting edge 60 and the ejector pin 56 is spaced from the end of the stem 26 remote from the head. The movable ram pin 48 is then advanced towards the blank precursor, entering the head recess and pushing the blank precursor towards the ejector pin until the stem 26 abuts the ejector pin which, in this position acts as a stop. During this movement of the blank precursor into abutment with the ejector pin, the conical projection 58 scrapes material from the entire circumferential surface of the first part 34 of the head and, by reason of the conical shape of the projection, deflects the scraped material radially outwardly as shown in FIG. 4*b*, to form the boss 52 in the shape of an undercut flange while relatively moving it away from the moving stem 26. As shown in FIG. 4*b*, the space between the stem 26 and the ejector pin is smaller than in the phase shown in FIG. 4*a* and the fourth stage is nearly complete. When the stem 26 finally abuts the ejector pin the scraping and moving phase is complete and the flange of material constitutes the boss 52 which in a subsequent operation is rolled over the core. Thus, the first operation of forming the mandrel blank is completed.

The mandrel blank thus produced is then transferred to a thread rolling machine of generally conventional construction. Instead of conventional thread rolling dies, however, the rolling machine is provided with a pair of mandrel rolling dies which are a mirror image of each other at least in such details as concern the process of the invention, the mandrel rolling dies having working faces which are appropriately contoured for making a mandrel from a mandrel blank.

Figure 5:
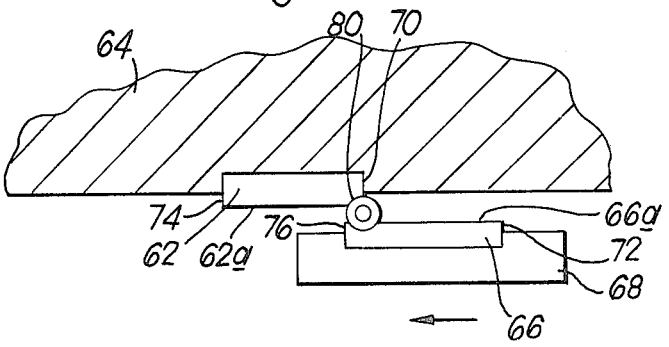
FIGS. 5 and 6 show schematically the operation of rolling dies in a thread-rolling machine in the performance of the method of the invention.
Figure 6:
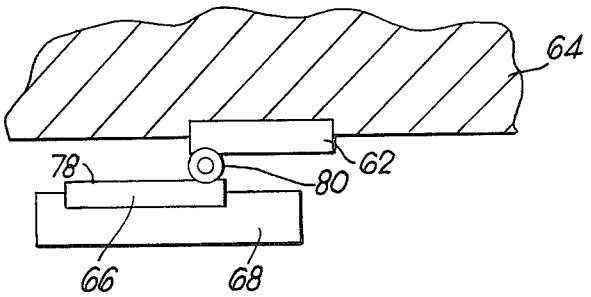
Figure 7:
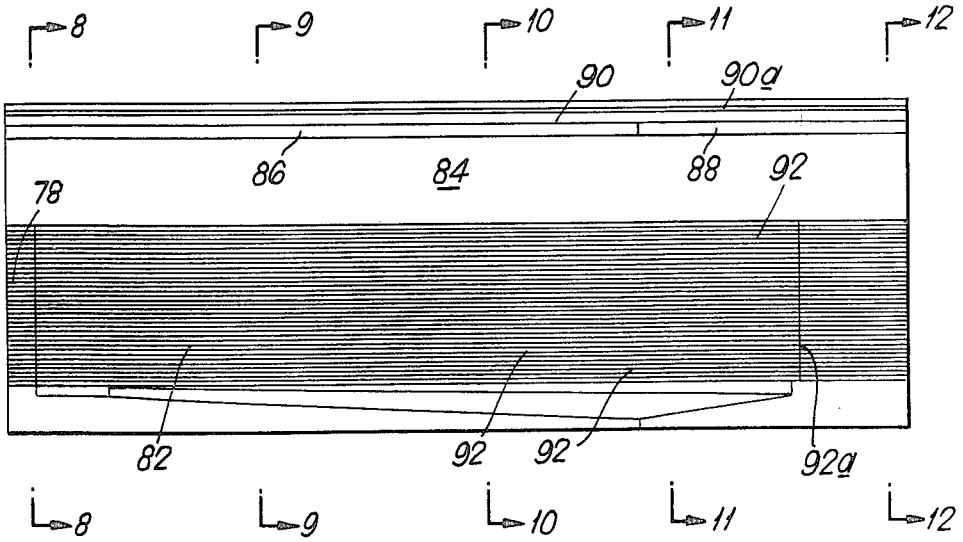
FIG. 7 is a plan view of the working face of one of the dies of FIGS. 5 and 6.

As shown schematically in FIGS. 5 and 6, one rolling die 62 is mounted on a fixed member 64 of a thread-rolling machine shown fragmentarilly, and the other rolling die 66 of the pair is mounted on a reciprocably movable member 68 of the machine so that the die 66 is movable to and fro past the die 62, as seen by comparison of FIGS. 5 and 6, movement in the direction of the arrow in FIG. 5 constituting a working stroke during which a mandrel blank is rolled and formed into a mandrel and then discharged, and movement in the opposite direction to the arrow constituting a return stroke during which no working is performed and the movable die 66 merely returns to a position ready to commence a working stroke.

Each of the dies 62, 66 is elongate and has an entry end 70, 72 respectively and a discharge end 74, 76, respectively, opposite the entry end. A minor difference between the two dies of the pair is that the moving die 66 is slightly longer than the fixed die 62, having a short extension providing a lead-in 78 for a mandrel blank at the entry end 72, the lead-in overlapping the entry end of the fixed die at the commencement of the working stroke.

Each of the dies 62, 66 has a working face 62*a*, 66*a* respectively, the working faces of the two dies being disposed facing each other with a space between them into which a mandrel blank 80 to be rolled is introduced at the commencement of the working stroke so as to lie on the lead-in 78 with its longitudinal axis transverse to the direction of movement of the die 66. The die 66 is then moved relative to the fixed die in the direction of the arrow in FIG. 5 to the position shown in FIG. 6 so that the mandrel blank is rolled between the working faces from the entry ends of the two dies to the exit ends where it is discharged.

Each die is a composite structure made up of a number of individual parts which are assembled together as may be seen in FIGS. 7 and 8 to 12. Each die comprises a pull-groove former 82, a spacer 84, a breaker groove roller 86, a flange roller 88 and a boss roller 90. With the exception of the spacer 84, these parts are contoured so as to work the mandrel blank so as to produce the final contours of a finished mandrel. Thus, the pull-groove former 82 has a plurality of parallel lands 92 which increase in height to a peak at 92*a* near the discharge end of the die and which progressively press into the stem of the mandrel blank to form a plurality of pulling grooves as the blank rolls towards the discharge ends of the dies. The spacer 84 spaces the pull-groove former 82 from the breaker groove roller 86 which provides a single knife edge land which extends parallel to the pulling groove forming lands 92 from the entry end of the die to a position short of the discharge end. The remaining distance between the breaker groove forming land 86 and the discharge end is occupied by the flange roller 88. In use, the breaker groove roller 86 progressively presses into the mandrel blank at the junction between the thickened part 32 of the stem and the core of the head to progressively form a circumferential breaker groove at the junction between the head and stem of the finished mandrel, with some consequent elongation of the mandrel blank. During the rolling of the breaker groove a flange of displaced material is thrown up adjacent to the breaker groove and this flange is subsequently rolled down again by the action of the flange roller 88 following the breaker groove roller 86 so that the thickened part 32 of the stem again becomes of substantially constant diameter throughout its length.

The boss roller 90 provides a single land 90*a* the cross sectional shape of which changes throughout the length of the land from the entry end of the die to the discharge end as can be seen by comparison of FIGS. 8 to 12. The land 90*a* engages the boss 52 of a mandrel blank 80 and presses against the boss in such a way that the material of the boss is progressively urged to flow in a direction towards the stem of the mandrel while the breaker groove is being formed by the breaker groove roller 86 and subsequently while the flange roller 88 is rolling down the flange formed during rolling of the breaker groove.

Figures 8, 9, 10, 11, 12:
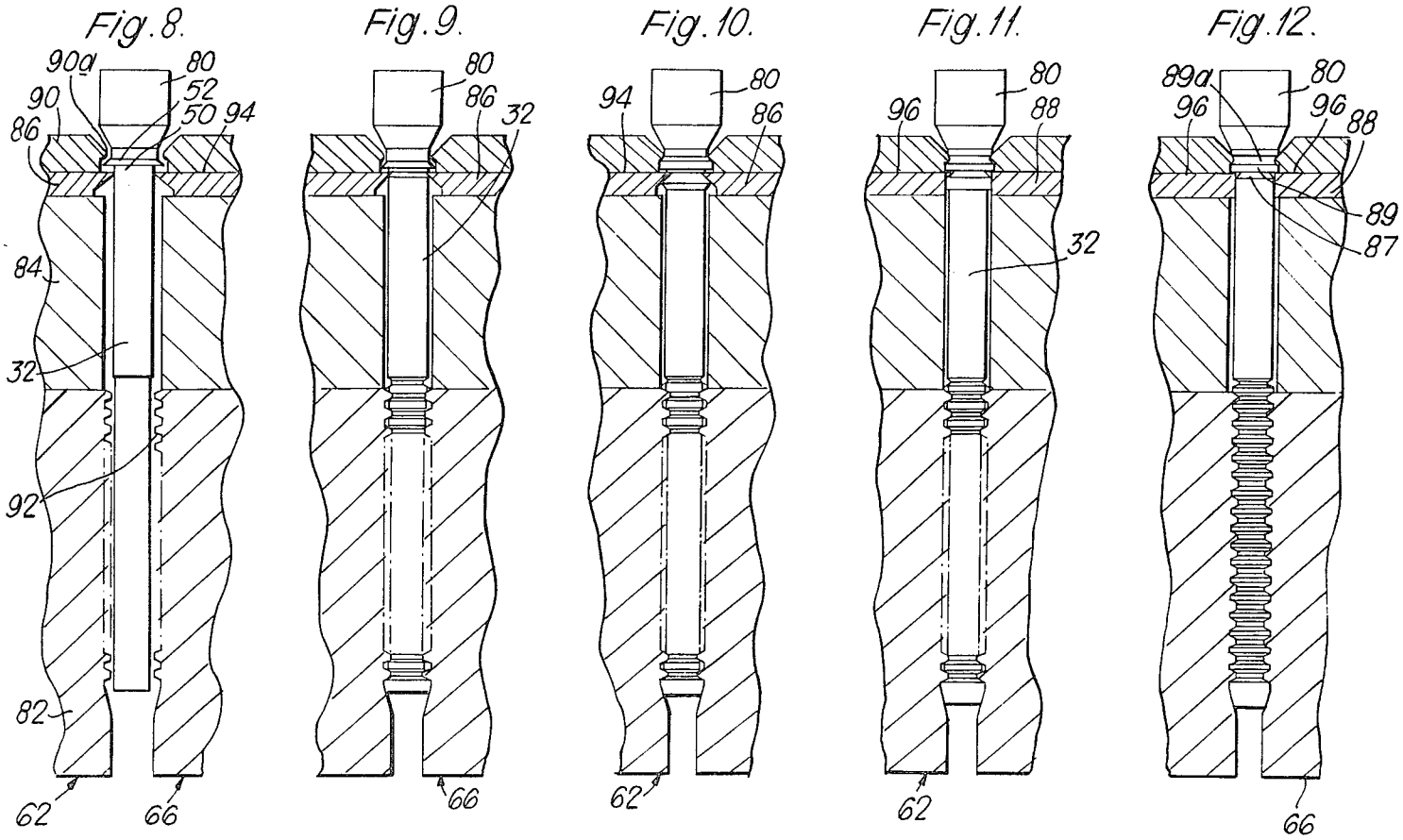
FIGS. 8 to 12 are detailed sectional views of a pair of rolling dies taken on the lines 8 through 12 respectively of FIG. 7 during the rolling of a mandrel blank seen in elevation between the dies.

As the material of the boss is urged to flow towards the stem of the blank, it flows over the scraped surface of the core portion 50 of the head of the mandrel blank, forming a skirt which peripherally surrounds the core 50. In addition to urging the material of the boss to flow over the core 50 towards the stem, the land 90*a* of the boss roller 90 progressively rolls the external surface of the skirt to a cylindrical shape of larger diameter than that of the thickened part 32 of the stem. As the material of the boss moves towards the stem, it eventually comes into abutment with a side face 94 of the breaker groove roller 86 and subsequently with a side face 96 of the flange roller 88, as shown in FIGS. 10, 11 and 12. The side faces 94 and 96 are those faces remote from the pulling groove former and lie substantially at right angles to the axis of the mandrel blank. It will be appreciated that the side face 94 of the breaker groove roller is necessarily aligned with the side of the breaker groove nearer the head than the stem, and the side face 96 of the flange roller 88 is aligned with the side face 94 so that the flange roller extends over the breaker groove previously formed by the breaker groove roller. It will therefore be understood that, as the material of the boss 52 is rolled towards the stem of the blank, it eventually comes into engagement with the side faces 94, 96 whereby it is restrained from flowing further towards the stem of the blank. The side faces thus confine the material of the boss to a position peripherally of the core 50 of the head so that the boss material cannot flow over the breaker groove but forms a shoulder abutting the side faces 94, 96 and substantially perpendicular to the axis of the mandrel and facing towards the stem from the side of the breaker groove remote from the stem. The material of the boss is thus formed into a skirt peripherally of the core and, as the boss material has been rolled over the core, there is a cylindrical cleavage between the core and the skirt which, in use of the mandrel as part of a self-plugging blind rivet, facilitates deforming the skirt radially outwardly away from the core into locking engagement with a rivet shell.

In this particular embodiment, the land 90*a* of the boss roller is of such cross sectional shape as to progressively form the external surface of the skirt to a cylindrical shape and then, towards the end of the rolling operation, to form a shallow circumferential groove at a position which is spaced from the breaker groove by a distance slightly greater than the length of the cleavage so that the groove does not reduce the thickness of the skirt between its external surface and the cleavage.

This groove is formed to facilitate assembly of the mandrel with a tubular rivet shell. If, however, the circumferential groove is not required, the land 90*a* is then shaped so as not to form the groove but merely so as to roll the boss down to form a skirt with a truly cylindrical external surface.

I claim:

1. A method of making a mandrel for a blind rivet, which method comprises first forming a blank having a generally cylindrical stem and a head, which head comprises a cylindrical core portion adjacent to and of substantially the same diameter as the stem, a boss spaced from the stem by the core portion and having a diameter greater than the core portion, and an end portion adjacent to the boss and having a diameter greater than the boss, and then rolling the boss downwardly toward the stem and over the core portion to form a skirt which peripherally surrounds the core portion and which has a greater diameter than the stem, forming a portion of said skirt into a shoulder extending transverse to the direction of the stem, and confining the material of said skirt so that said skirt surrounds only said core portion.

2. A method as claimed in claim 1, in which the blank is formed from a blank precursor having a generally cylindrical stem and a head, wherein the head comprises a first part adjacent to the stem and of substantially greater diameter than the stem, and an end part of greater diameter than the said first part, the method including the step of moving peripheral material from the surface of the said first part of the blank precursor in a direction away from the stem to leave the said core of substantially the same diameter as the stem, and forming the said boss at a position from the stem out of the peripheral material moved from the core.

3. A method as claimed in claim 2, including the step of moving the peripheral material from the surface of the said first part by scraping the peripheral material towards the end part of the head.

4. A method of making a mandrel for a blind rivet, which method comprises first forming a blank having a generally cylindrical stem and a head, which head comprises a cylindrical core portion adjacent to and of substantially the same diameter as the stem, a boss spaced from the stem by the core portion and having a diameter greater than the core portion, and an end portion adjacent to the boss and forming a breaker groove at the junction of the stem and the core and urging the material of the boss to flow over the surface of the core portion and towards the stem to form a skirt which peripherally surrounds the core portion and which has a greater diameter than the stem.

5. A method according to claim 4, wherein the material of the boss is restrained from flowing beyond the core portion, thereby confining the skirt to a position peripherally of the core portion.

6. A method according to claim 4, wherein the flow of the material of the boss is restrained so that the skirt does not extend across the breaker groove.

7. A method according to claim 4, wherein the material of the boss is urged to flow into abutment with a surface substantially perpendicular to the axis of the blank, thereby forming the material into a skirt which presents an annular shoulder which faces in a direction away from the head and towards the stem.

8. A method according to claims 4, or 5, or 6 or 7, wherein the blank is rolled between a pair of rolling dies to form the skirt.

9. A method of making a mandrel for a blind rivet, which method comprises first forming a blank having a generally cylindrical stem and a head, which head comprises a cylindrical core portion adjacent to the stem and having a diameter of the same as or minutely greater than that of the stem, a boss spaced from the stem by the core portion and having a diameter greater than the core portion, and an end portion adjacent to the boss and having a diameter greater than the boss, forming a breaker groove at the junction of the stem and the core, and then urging the material of the boss to flow over the surface of the core portion and towards the stem to form a skirt which peripherally surrounds the core portion and which has a diameter greater than that of the stem.

10. A method according to claim 9, which includes forming a breaker groove at the junction between the stem and the core and confining the material of the boss so that it cannot flow over the breaker groove.

11. A method of making a mandrel for a blind rivet, which method comprises forming a blank precursor having a generally cylindrical stem and a head, wherein the head comprises a first part adjacent to the stem and of substantially greater diameter than the stem, and an end part of greater diameter than the said first part, and then scraping peripheral material from the surface of the said first part of the head in a direction away from the stem to leave a cylindrical core adjacent to the stem and having a diameter the same as or minutely greater than that of the stem, and forming a circumferential flange-like boss out of the said peripheral material at a position spaced from the stem by the cylindrical core, and thereby forming a mandrel blank, and then rolling the mandrel blank so as to urge the material of the boss to flow over the surface of the core in a direction towards the stem and thereby forming a skirt which peripherally surrounds the core and a cylindrical cleavage between the skirt and the core.

12. A method according to claim 11, which includes rolling a breaker groove at the junction between the stem and the core and confining the material of the boss so that it does not flow across the breaker groove.

* * * * *